United States Patent [19]

Carson

[11] Patent Number: 4,577,571

[45] Date of Patent: Mar. 25, 1986

[54] APPARATUS FOR FINISHING WAISTBAND END PORTIONS

[76] Inventor: Charles F. Carson, 2503 Lakeshore Dr., Greensboro, N.C. 27407

[21] Appl. No.: 708,650

[22] Filed: Mar. 6, 1985

[51] Int. Cl.[4] ..... D05B 23/00; D05B 35/00

[52] U.S. Cl. ..... 112/121.15; 112/121.27; 112/311; 223/43

[58] Field of Search ..... 112/121.26, 121.27, 112/10, 11, 2, 63, 303, 311; 223/42

[56] References Cited

U.S. PATENT DOCUMENTS 3,310,207 3/1967 Goae ..... 112/10 X 3,507,234 4/1970 Bryan ..... 112/121.27

*Primary Examiner*—H. Hampton Hunter

*Attorney, Agent, or Firm*—Charles R. Rhodes; Judith E. Garmon

[57] ABSTRACT

Improvements to a waistband end folding and stitching apparatus of the type in which the open terminal free end portion of an unfinished waistband having opposed fabric plies is presented to a folding station where the end portion is (1) inverted into the space between the spread plies to form an inturned edge; (2) the multiple plies of fabric are flattened by the application of pressure from a pair of opposed feet to facilitate sewing; (3) automatically transferred laterally in a horizontal plane to a seaming or stitching station, and (4) positively positioned in alignment with the sewing head for the application of at least one row of stitches parallel to and adjacent the inturned edge. The moving parts of the apparatus are hydraulically and pneumatically operated responsive to the predetermined program. At the end of the transfer stroke, the waistband end portion is received by a gripping apparatus then shifted into positive engagement with a lower stripper plate in proper alignment with the needle for the stitching operation.

10 Claims, 23 Drawing Figures

APPARATUS FOR FINISHING WAISTBAND END PORTIONS

BACKGROUND AND SUMMARY OF THE PRESENT INVENTION

The garment industry has for many years relied upon manual operation in the fabrication ("cutting and sewing") of garments with negligible advancements being made in automation and machinery to reduce cost, improve quality and uniformity, and to increase production. Numerous manual operations necessary for end finishing waistbands in garments such as pants, skirts, and shorts provide troublesome, time consuming, and tedious operations. Presently, waistbands are formed by folding and seaming an elongated section of fabric lengthwise, which section is then secured to the upper edge of a garment with the ends of terminal portions of the waistband that are unfinished extending beyond the side edges of the garment. The free terminal end portions must then be turned inwardly through an inversion of the end portion to tuck the end portion inwardly into the area between the plies of the secured portion of the waistband in order to form a coincident finished edge preparatory for seaming on a sewing machine. In the past, until the invention of the apparatus described in U.S. Pat. No. 3,507,234 to Bryan, such operations were accomplished manually with the result that production bottlenecks problems occurred particularly in the manufacture of medium and low priced trousers, work pants, jeans, sport clothes, and among other apparel in which a waistband or comparable end finishing is required.

With the advent of the apparatus described and illustrated in U.S. Pat. No. 3,507,234, the tedious manual operations were substantially eliminated with an apparatus that could mechanically invert the free terminal end portion of the waistband and automatically transport it to a sewing station for closing the finished edge. Such apparatus was substantially completely mechanical in that the timing and activation of the instrumentalities that perform the clamping, spreading, inverting, releasing, and transportation of the end portion to the sewing head were effected by a main rotating cam shaft which in turn operated a series of cams, levers, springs, slides, tie rods, and the like to perform the inverting and transporting operations. While this approach represented a remarkable improvement over the previous manual operations, as time went along, new problems and the need for further improvements arose.

For example, since the driving force and relative timing of all the operations were generated from the single rotating cam shaft, where it became necessary to adjust critical timing intervals for one reason or another, such operation was very difficult to accomplish. The system of cams, levers, springs, slides, tie rods and the like was extremely complicated and as parts began to wear, this had a considerable effect on the relative operation and timing of the entire apparatus. Further, in the referenced patent, the transporting of the end portion from the inverting head to the sewing apparatus required a multi-planar movement and rotation of the end portion. As a result, it was complicated and difficult to position the finished edge in proper alignment with the sewing head to effect a seam that was consistently acceptable and parallel to the finished edge. Also, the inverting of the tubular end portion of the waistband back into itself resulted in a finished edge comprising an extremely bulky area of fabric adjacent the upper edge of the garment (four plies in the waistband, two folds, and at least one ply in the garment upper section). Such a gathering of a fabric, such as denim used in the manufacture of jeans and skirts, becomes extremely bulky and when presented to the sewing head, would sometimes result in a seam in which the stitches were unsatisfactorily formed or was otherwise unsatisfactory. Therefore, even though the apparatus described and illustrated in U.S. Pat. No. 3,507,234 represented a remarkable improvement over the manual technique for inverting and seaming the terminal end portions of the waistband, there resulted a substantial number of unacceptable garments and further improvements were sought.

In the machine according to the present invention, the spreading of the fabric plies, the folding of the terminal end portions, the transporting of the waistband to the sewing head, and the positioning of the waistband in position for the sewing operation are accomplished by hydraulic and pneumatic cylinders operated responsive to an electro-mechanical control system. The use of hydraulic and pneumatic cylinders and electro-mechanical controls significantly simplify the apparatus, make the timing easier to adjust, and minimize the wear on the operative parts of the apparatus. During the folding operation, after the terminal end portions have been inverted, while the fabric plies are still spread apart, and before the impaling tongue has been reintroduced into the waistband, a flattening operation is performed on the area of the fabric immediately adjacent the finished edge to reduce the bulk thereof in preparation for the sewing operation. Toward this end, a pair of opposed, vertically aligned "flattening" feet are brought together with the fabric portion to be treated therebetween.

Once the folding or inverting and flattening operation has been completed, the waistband is transferred in a single planar movement to the sewing head assembly where the waistband is received and gripped by a gripping apparatus, then positively moved inwardly to a stop means properly aligned beneath the sewing head. This eliminates the multi-planar movement of the original apparatus and also positively positions the finished edge of the waistband portion against a stop member to ensure that the ensuing seam extends parallel to and closely adjacent the finished edge. The resulting product then is improved because the combination of the flattening operation and the positive positioning of the finished edge beneath the sewing head ensures that a consistently acceptable seam is formed parallel to and adjacent the finished edge on each and every garment. As a result, the number of unacceptable garments is considerably reduced.

It is therefore one object of the present invention to provide an improved waistband end finishing apparatus and method which facilitates the closing of the open end of a waistband.

Another object of the present invention is to provide an end finishing apparatus and method of the type described in which the fabric area adjacent the finished edge is flattened subsequent to the folding operation and preceding the sewing operation.

Yet another object of the present invention is to provide a waistband end finishing apparatus and method of the type described in which subsequent to the folding operation, the waistband is transferred in a simple, uniplanar path to the sewing head assembly where it is positively positioned against a stop means in preparation for the seaming operation.

Other objects and a fuller understanding of the invention will become apparent from the following drawings in which.

Figure 5:
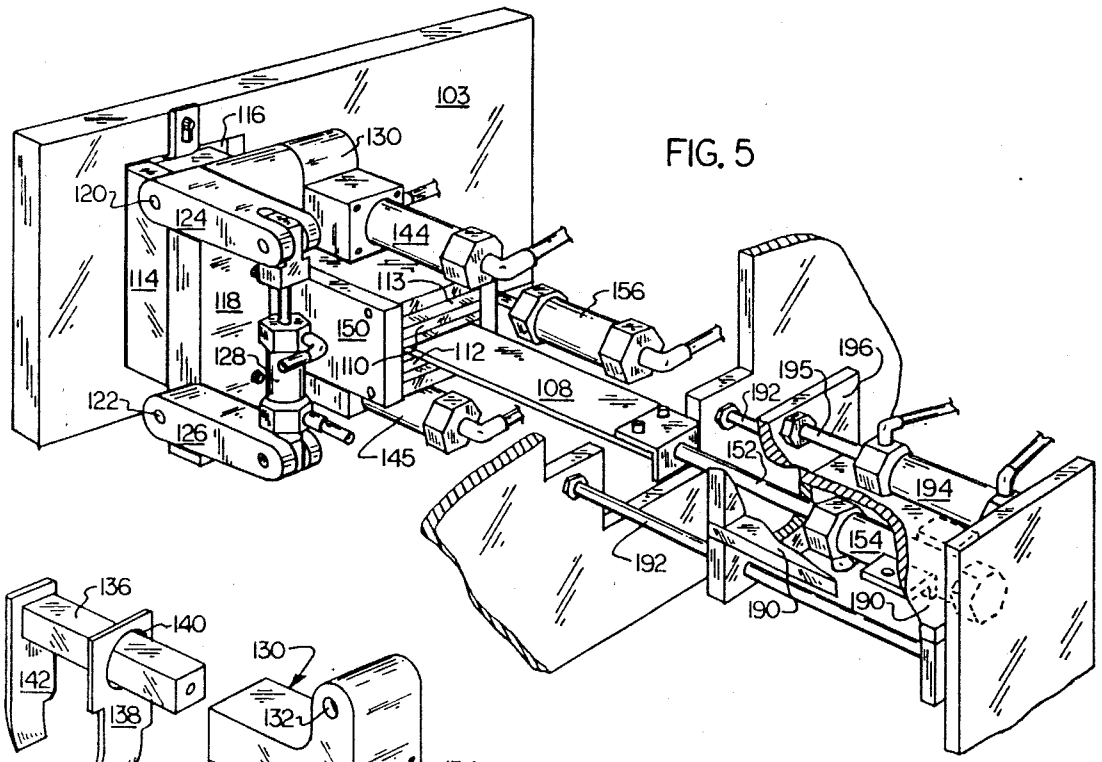
FIG. 5 is a perspective view, with parts broken away, illustrating the rear side of the folding and inverting apparatus.
Figure 5A:
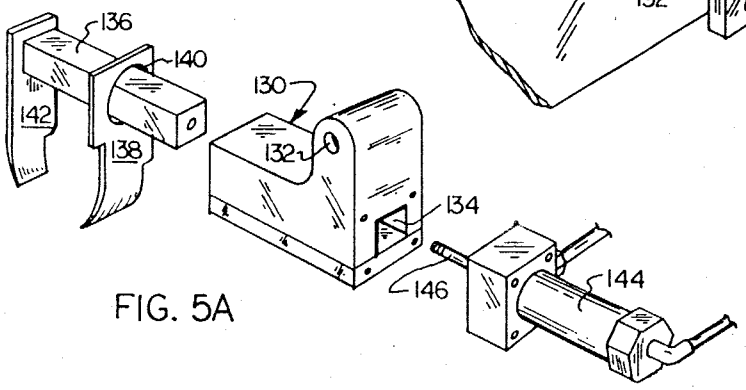
Figure 5B:
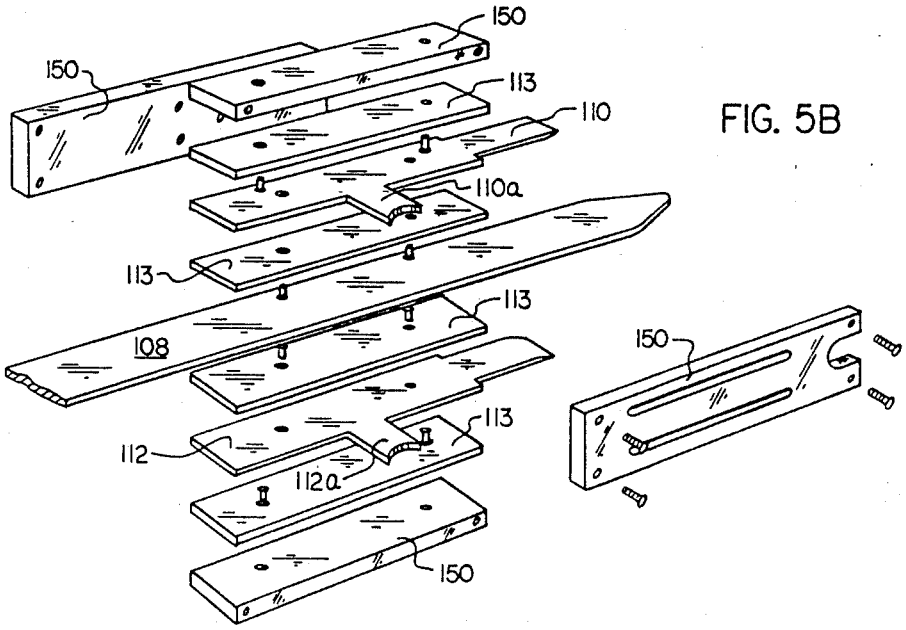
Figure 10:
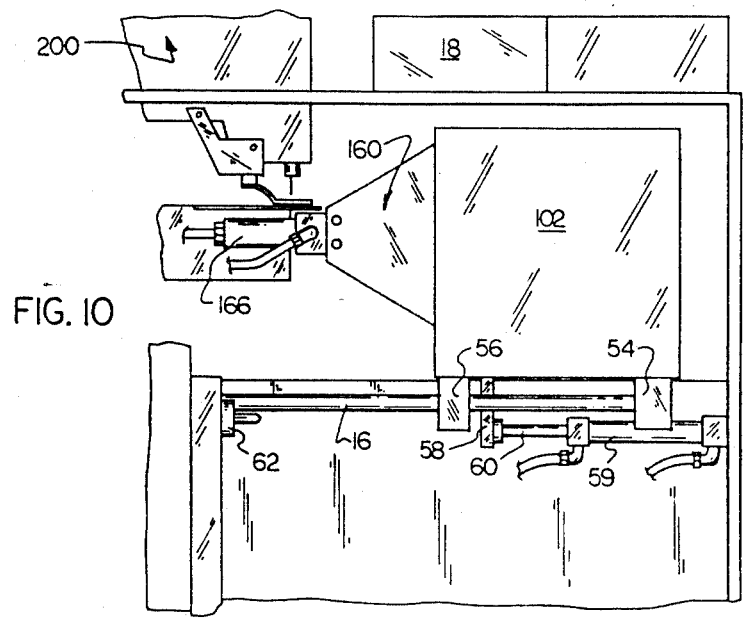
Figure 6:
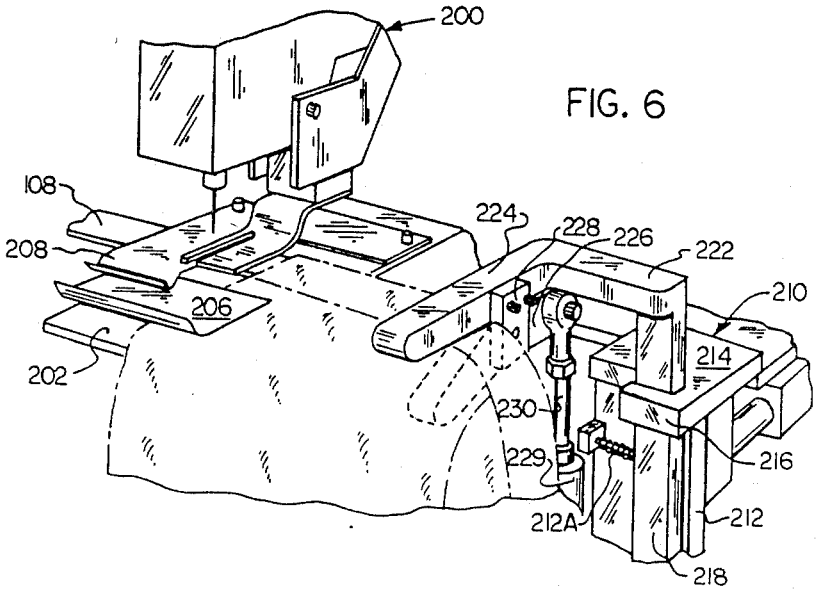
Figure 7:
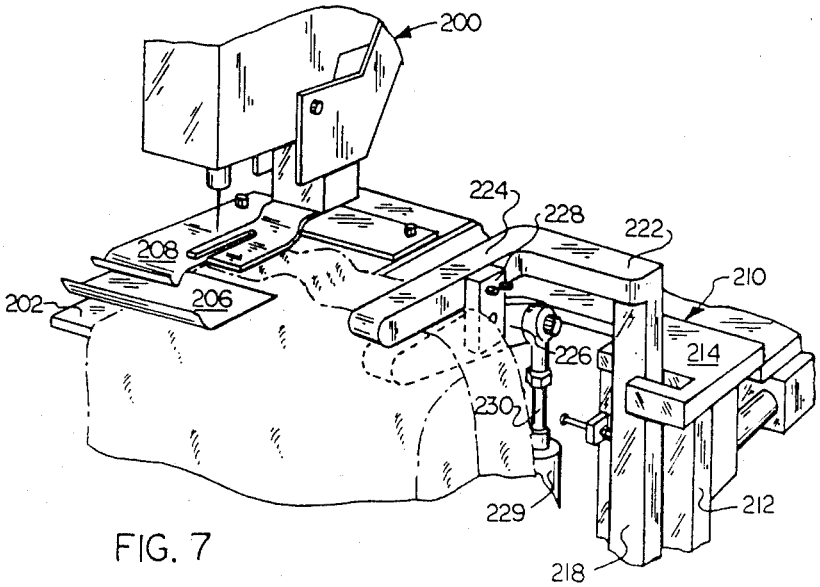
Figure 11A:
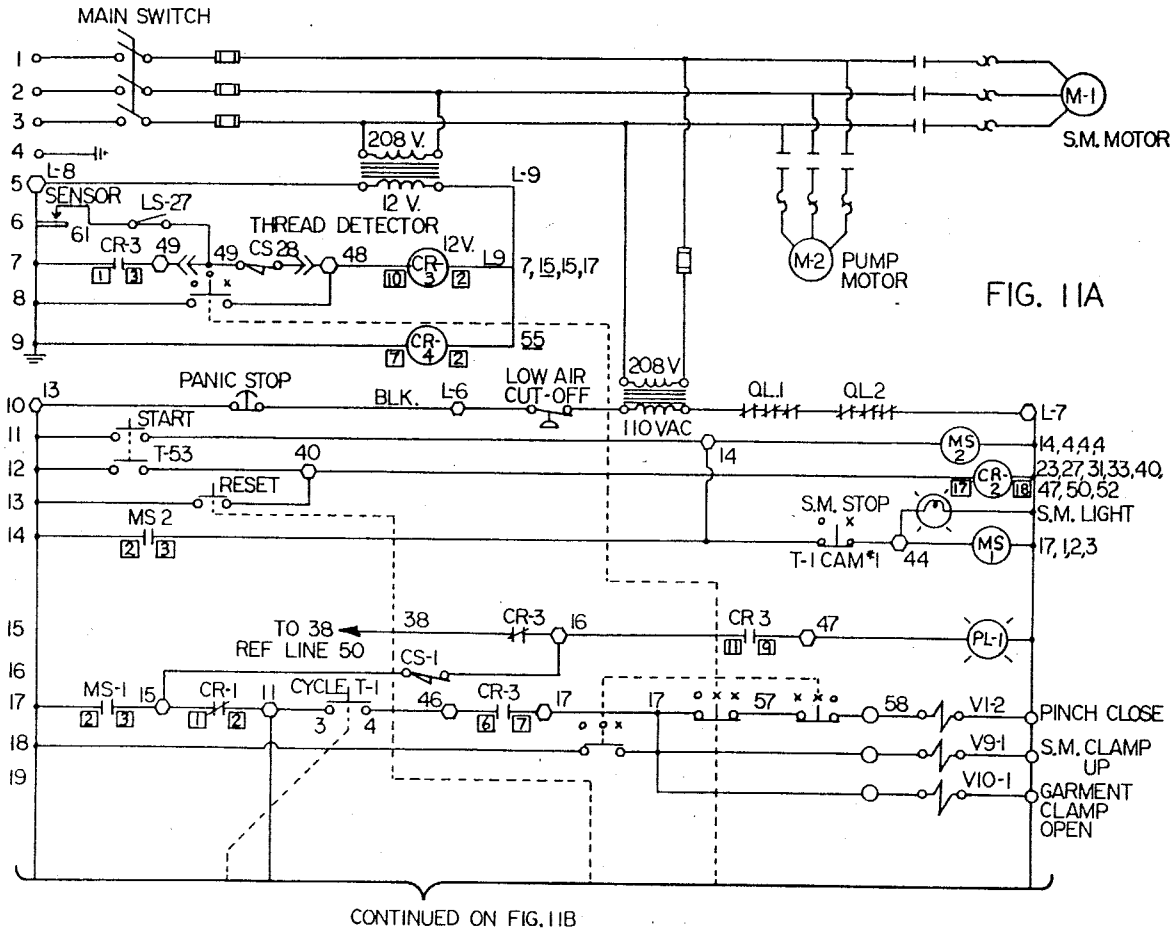
Figure 11B:
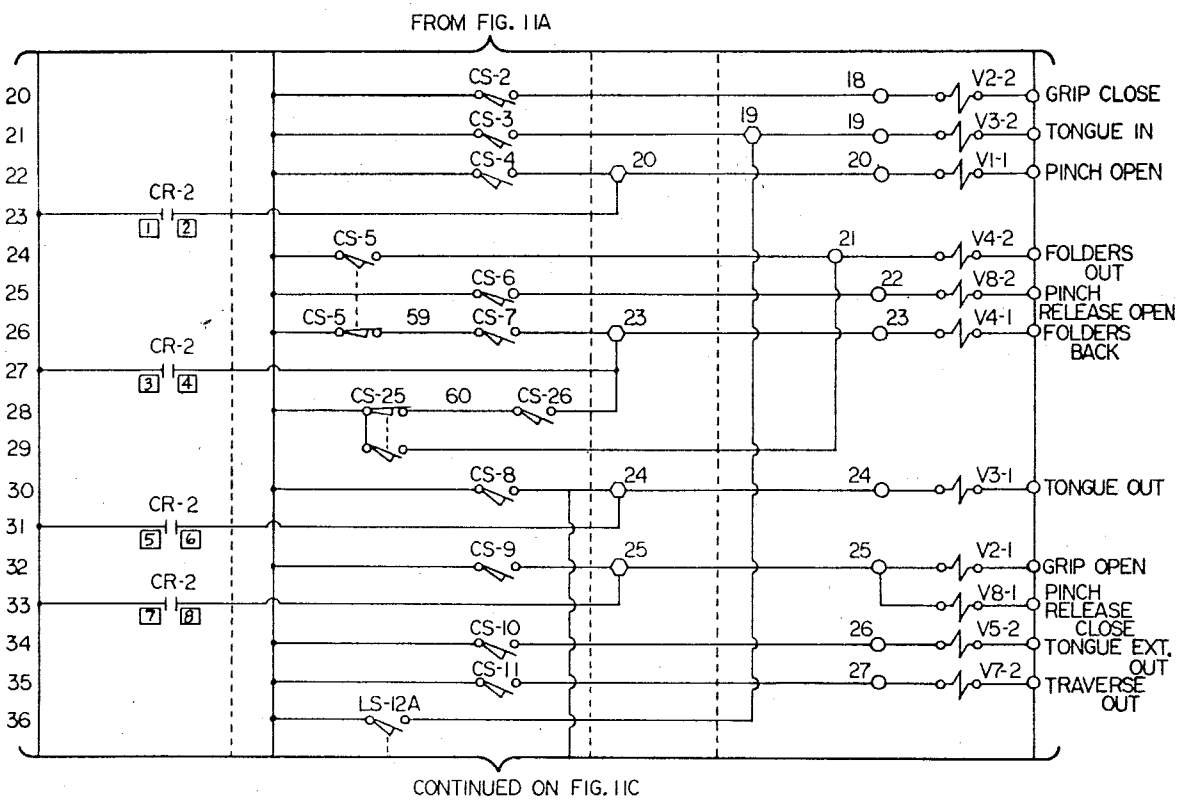
Figure 11C:
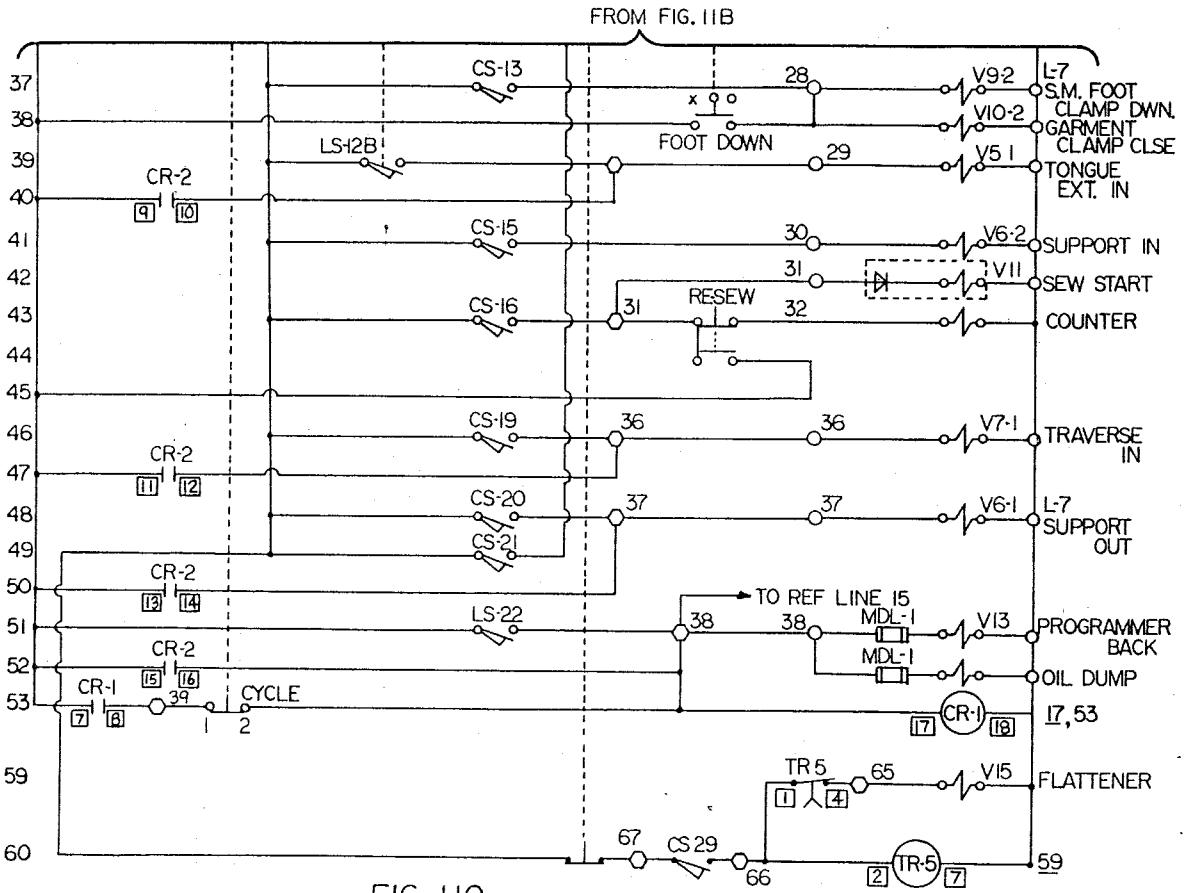
Figure 12:
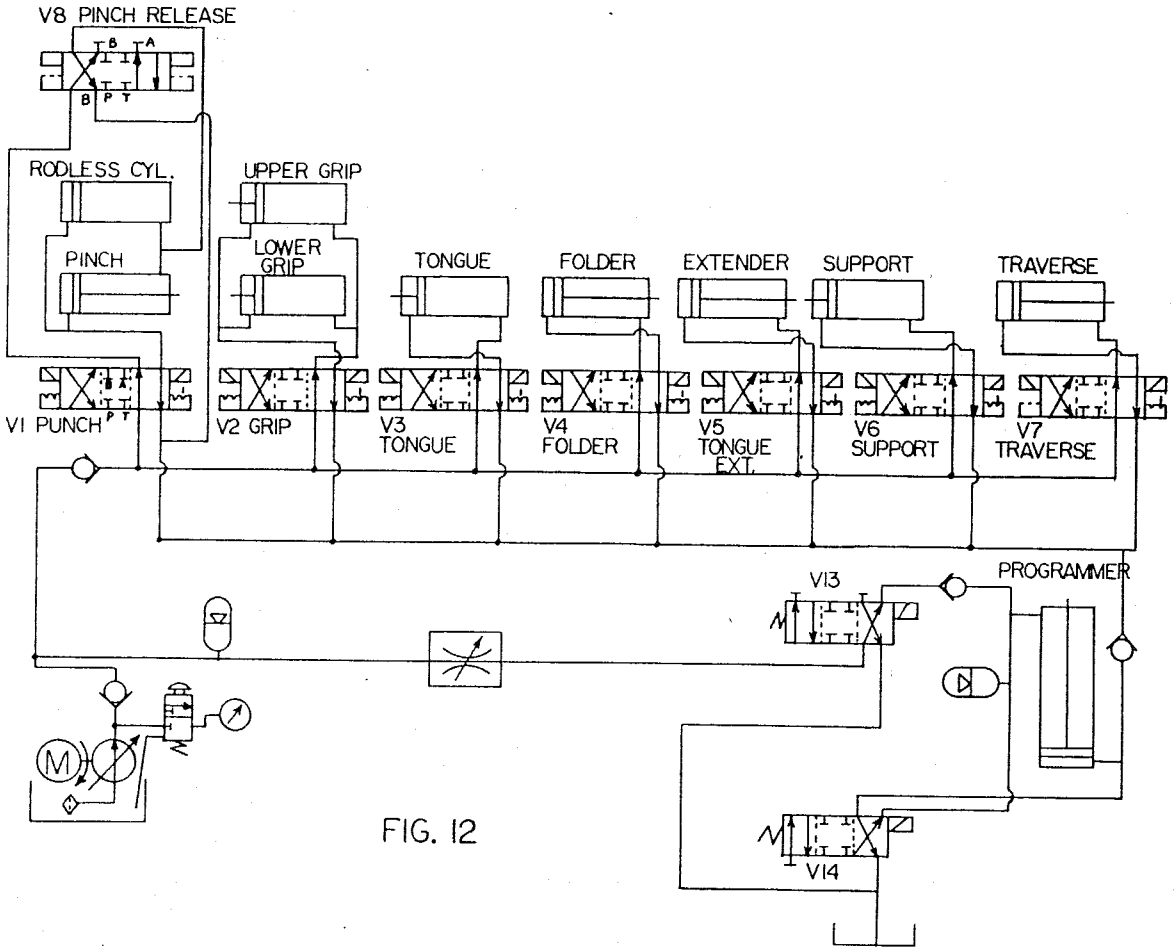
Figure 13:
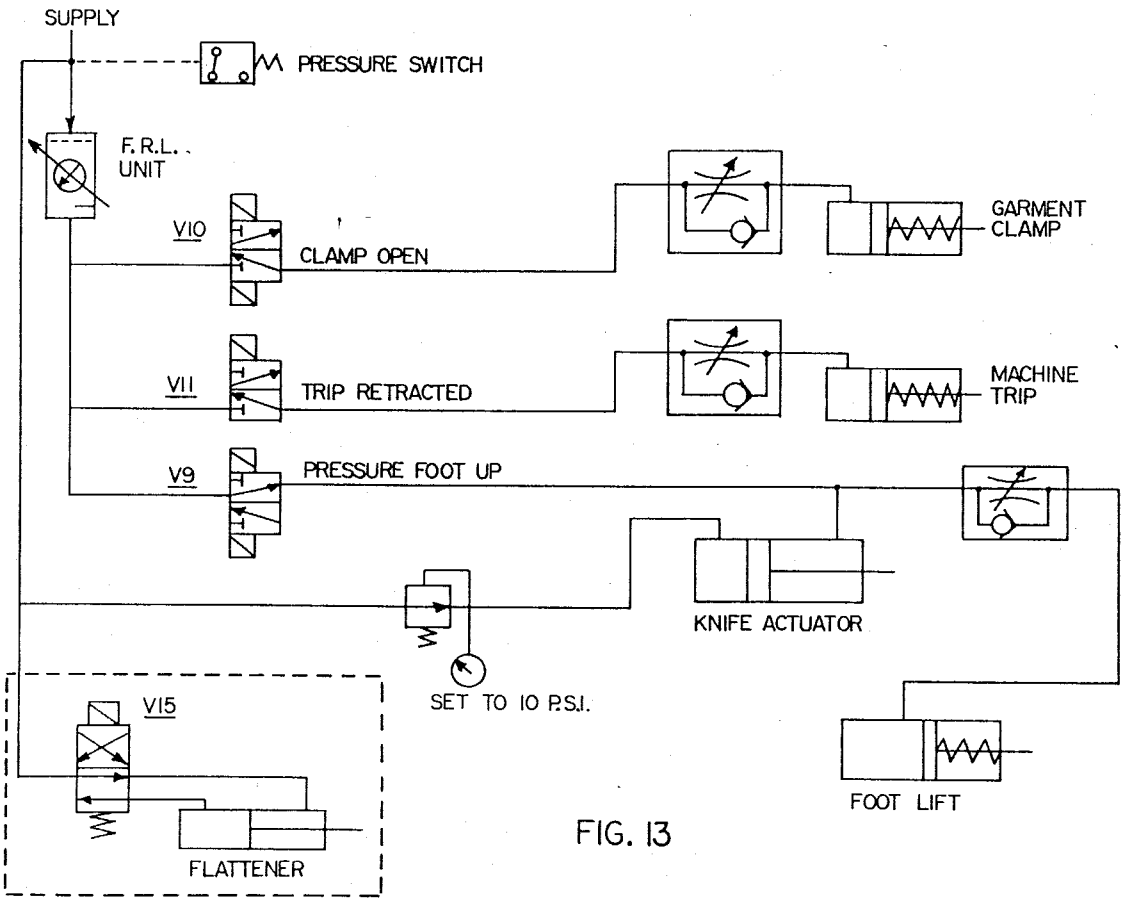

FIG. 5*a* is an exploded perspective view illustrating one of the pincer assemblies removed from the apparatus;

FIG. 5*b* is a perspective view of the impaling tongue/folder blade support housing removed from the apparatus;

FIG. 6 is an enlarged perspective view illustrating the sewing apparatus and waistband positioning apparatus alone in a first position preparatory to receiving a waistband for the sewing operation;

FIG. 7 is a perspective view similiar to FIG. 6, except showing the sewing apparatus and positioning apparatus in a second position with the waistband properly positioned for the seaming operation;

FIGS. 8*a* through 8*h* are side views which illustrate schematically and sequentially the operations performed in a waistband to effect the folding and flattening operation;

FIG. 9 is a perspective view, with parts broken away, of the electro-mechanical programmer assembly which sequences the apparatus illustrated in FIGS. 1–7;

FIG. 10 is a rear elevational view of the underside of the apparatus, with parts broken away showing the carriage mounting and transferring mechanism;

FIG. 11 is a schematic electrical diagram of the end finishing and sewing apparatus;

FIG. 12 is a schematic diagram of the hydraulic system incorporated on the apparatus; and FIG. 13 is a schematic diagram of the pneumatic system incorporated on the apparatus.

DETAILED DESCRIPTION OF A PREFERRED EMBODIMENT

For the purpose of this description and specification, and without any limitation intended, a "waistband" for a garment generally consists of at least two fabric plies positioned adjacent each other and secured to form a substantially flat, open end tube. Garments such as jeans, work pants, denim jackets, slacks, and skirts are often provided with the major portion of the garment and the waistband formed separately. The waistband is fabricated from a length of material folded over into two plies of fabric contiguous to each other with the waistband being subsequently stitched securely to the upper edge of the garment along the lower edge of the band. In the fabrication of waistbands, predetermined lengths of fabric are cut and folded, and the top edge of a garment is inserted between the free edges thereof, whereupon a seaming operation connects the waistband and garment. Freely extending open terminal end portions extend from the waistband past the finished garment edges irrespective of whether the finished edges of the garment are for a fly front or side of a garment. The free open ends then must be inverted or tucked inwardly, referred to herein as "inverting," "tucking," or "folding," into the attached edge of the waistband a distance sufficient to permit the formation of a finished edge E substantially contiguous with the adjacent edge of the fly front or edge as shown throughout the drawings preliminary to the forming of a final seam S which forms the finished edge of the garment waistband. The apparatus provided will support a portion of the waistband that includes the free terminal end portion thereof during the entire folding, flattening, transporting, and sewing operations.

There is illustrated in FIGS. 1–7, 9 and 10, a preferred embodiment of a waistband end finishing machine 10 that is supported on machine framework 12 mounted on vertically adjustable legs 14. In general the machine 10 includes an inverting head assembly 100, a sewing head assembly 200, and an electro-mechanical control system (FIG. 9) suitably mounted on the machine framework 12 as will be described more fully hereinafter. The inverting and flattening operation is performed on the inverting head assembly 100, whereupon the entire inverting head assembly 100 is shifted horizontally on a pair of rails 16 extending between portions of the framework 12 over to the sewing head assembly 200, where the waistband will be received and properly introduced to the sewing instrumentalities, as the inverting head assembly returns to its normal position.

Figure 1:
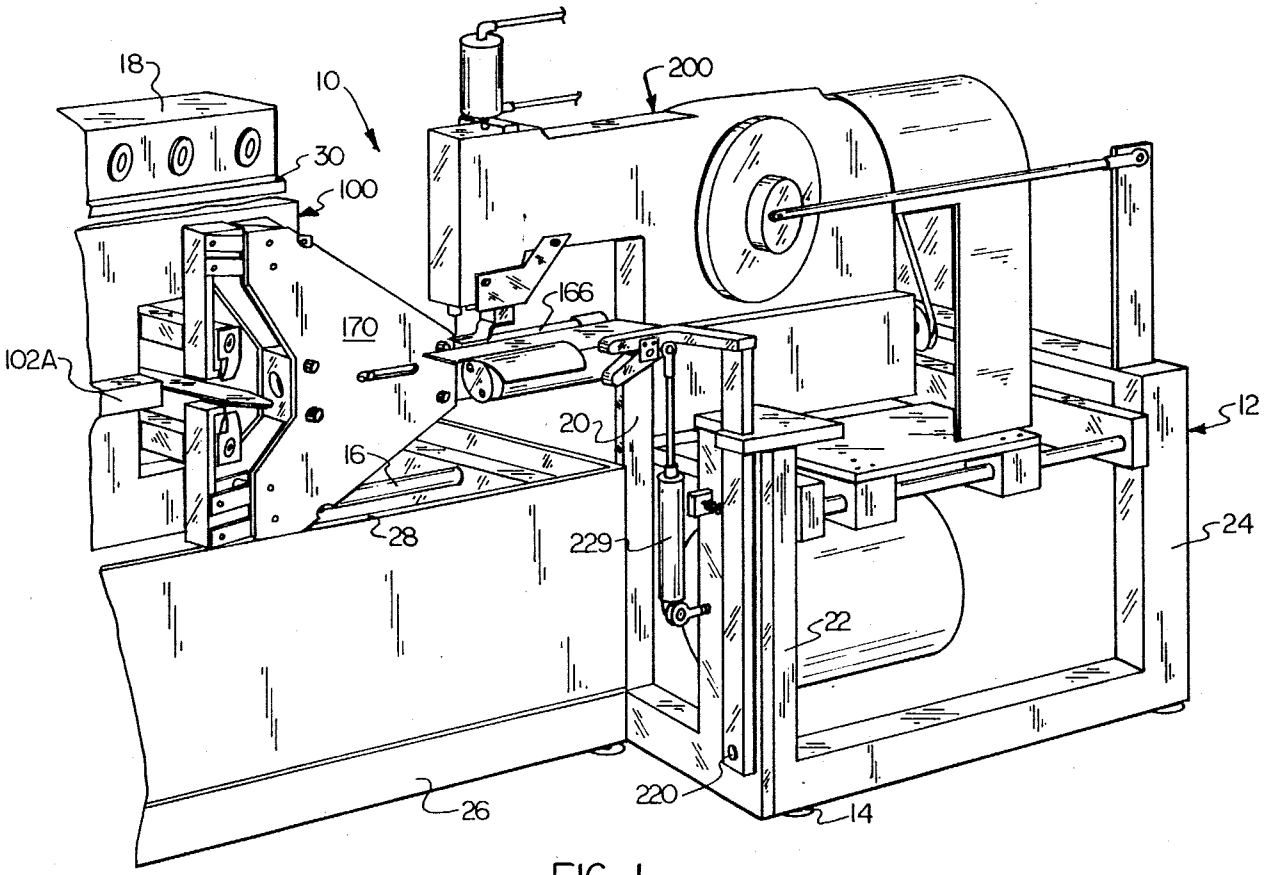
FIG. 1 is a perspective view of the apparatus according to the present invention looking from the front and one end.

The operator console 18 is stationarily mounted on the machine framework 12. The framework 12 in general comprises a plurality of upright posts, some of which are illustrated in FIG. 1 as posts 20, 22, and 24 joined together by a plurality of horizontal rail members 26, 28, and 30. Other upright and horizontal posts and rail members form the sides and rear of the machine framework in a conventional manner.

Following in the specification, specific reference will be made to various mechanisms and motions including (a) waistband clamping and folding mechanism, (b) waistband end flattening mechanism, (c) mechanism for transporting waistband end portion to sewing head assembly, (d) mechanism for gripping and positively positioning waistband end portion to sewing head, (e) electro-mechanical control system, (f) electrical and hydraulic operation, and (g) sequential operation.

(a) Waistband Clamping and Folding Mechanism

Figure 2:
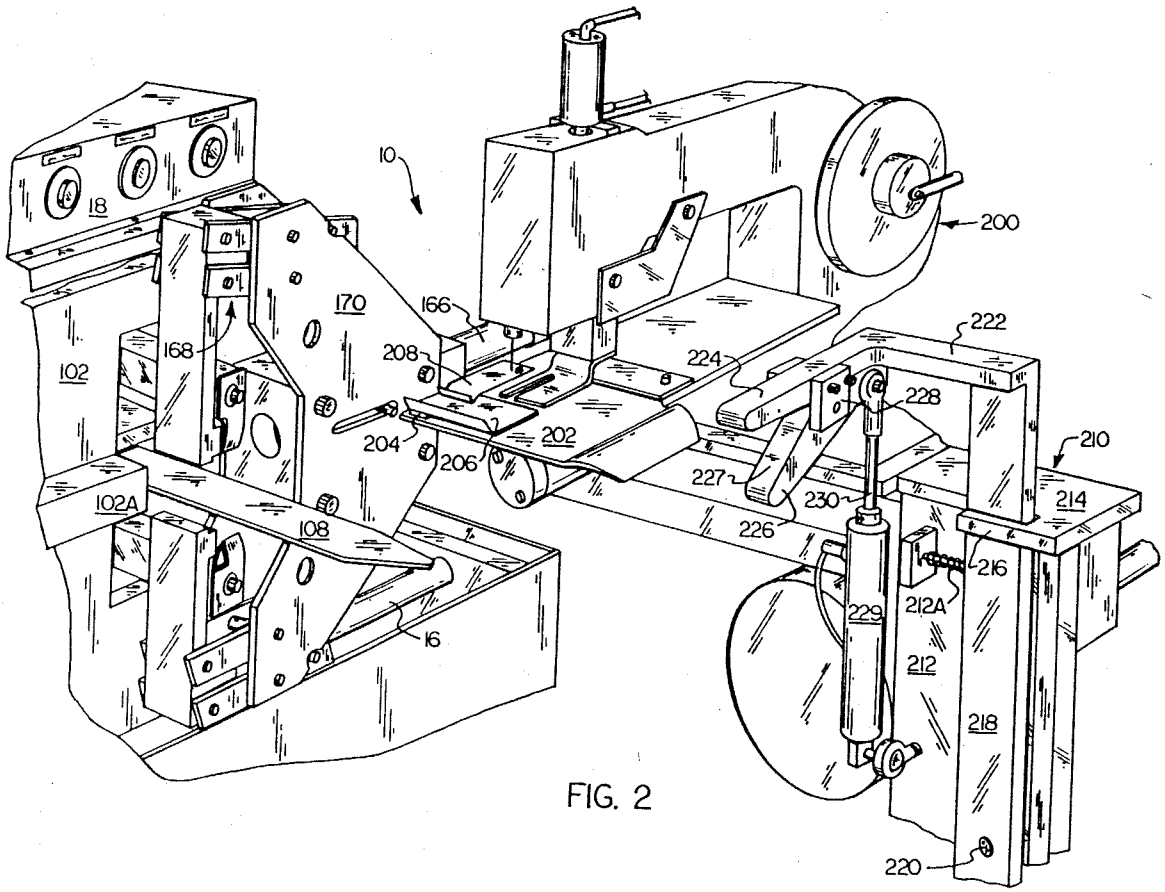
FIG. 2 is an enlarged perspective view illustrating the front portion of the folding and flattening device and the sewing apparatus along with the gripping device which holds the waistband and properly positions it for the sewing operation.
Figure 3:
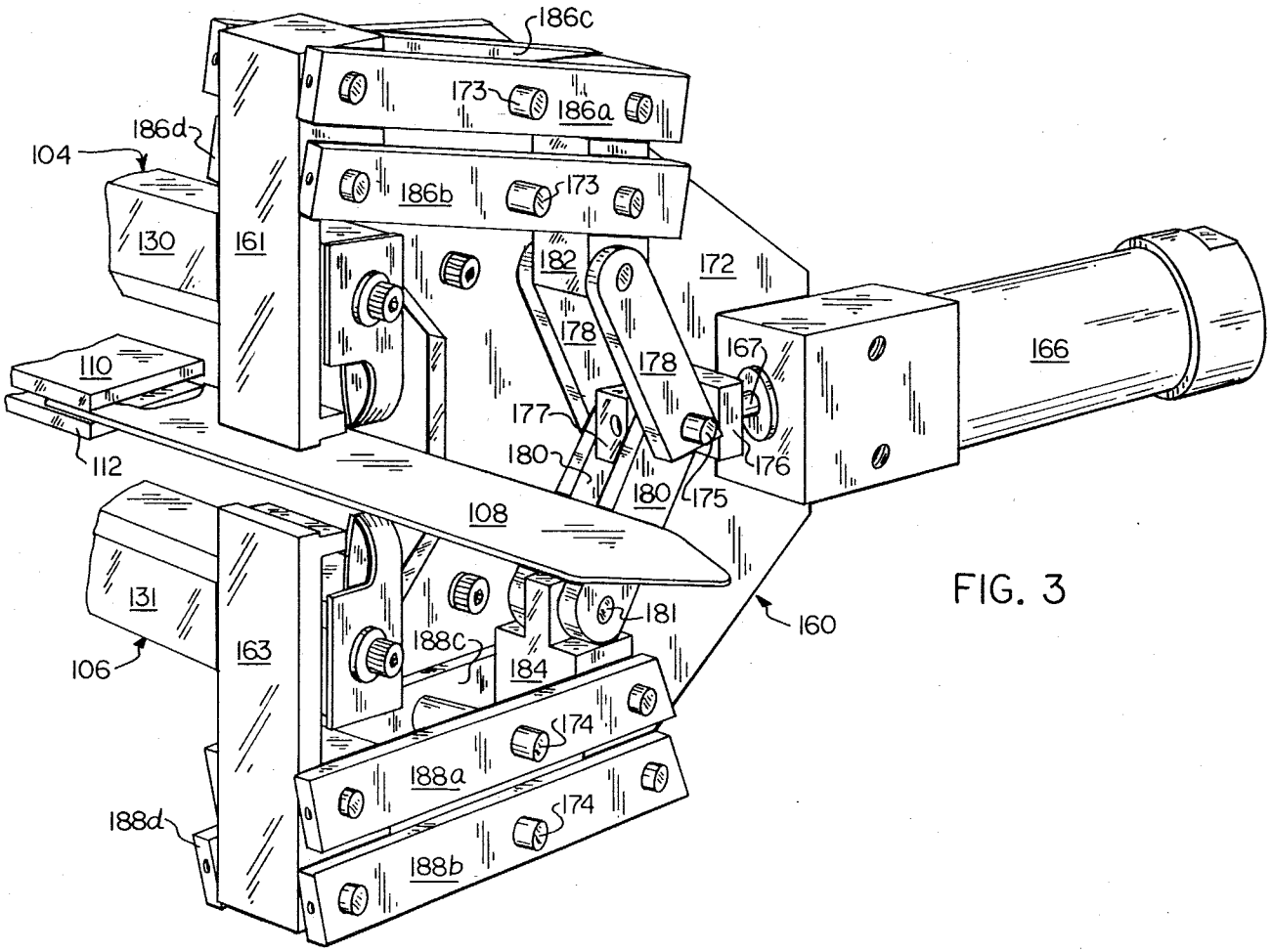
FIG. 3 is a perspective view, with parts broken away of the folding and flattening apparatus in a first position.
Figure 4:
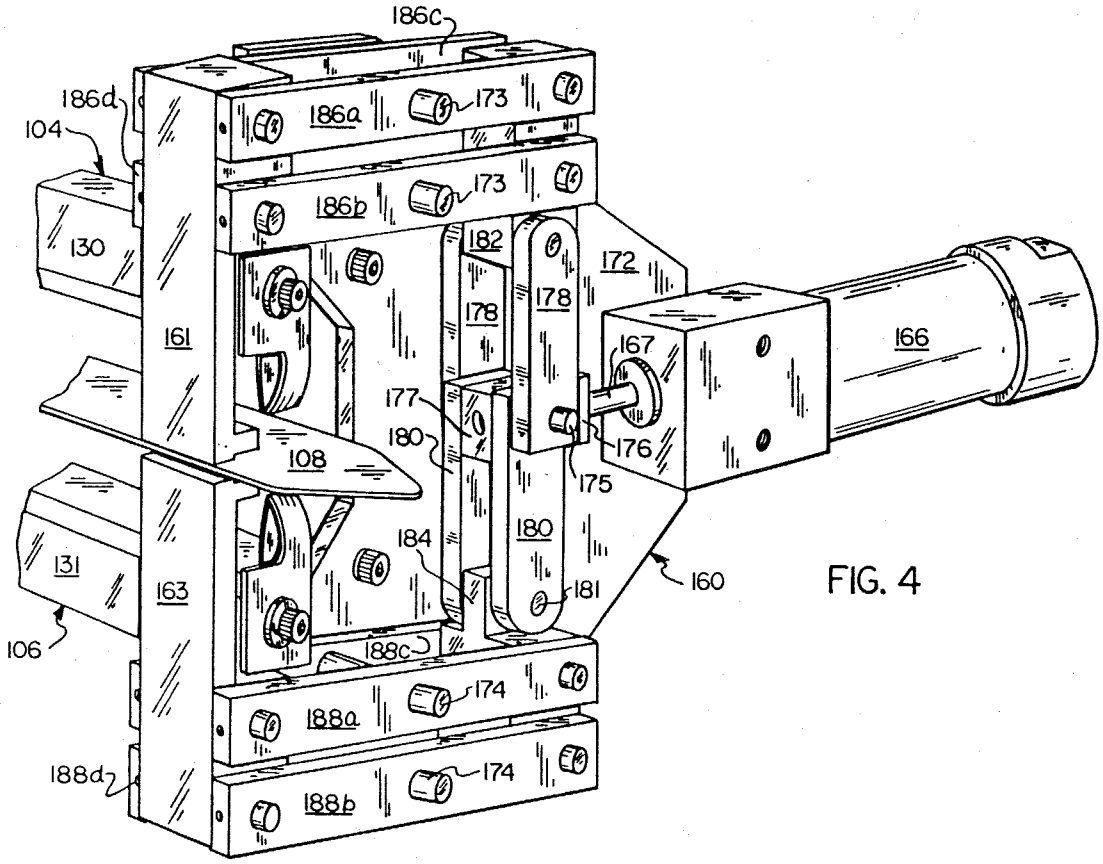
FIG. 4 is a perspective view similar to FIG. 2 except showing the flattening device in a second position.

Turning now to FIGS. 1–5, the waistband clamping and inverting head assembly 100 is carried by a carriage 102 having a front plate 103 (FIG. 5). The clamping and inverting, in general, are effected by a pair of pivotally mounted clamps or pincer assemblies 104,106, a forward and rearwardly movable impaling tongue 108, and a pair of reciprocal invert-ing or folding blades 110,112. The waistband clamping and spreading pincers or clamps 104,106 are positioned adjacent and in juxtaposition to the waistband impaling tongue 108 with opposed pivotable fabric clamping assemblies 104,106 being positioned above and below the tongue member 108 and in spaced relation thereto in the tongue projected position as shown in FIG. 3. It is the purpose of the clamping assemblies 104,106 to grasp and clamp opposite plies of the waistband fabric plies at a point slightly forwardly of the eventual finished edge, then spread the plies apart to facilitate the ensuing inverting operation. The impaling tongue 108 is guidably supported for horizontal reciprocation for threading and impaling the free terminal end of a waistband thereon for support of the waistband in preparation for the inverting operation. Tongue 108 extends into the carriage 102 through the front wall 103 for reciprocal operation as will be described hereinafter. During the inverting operation, the tongue 108 is retracted so that inverter blades 110,112 may be extended to accomplish the inverting step. Once the inverting step has been accomplished, the impaling tongue 108 is again extended to its intermediate position to again support the waistband thereon, whereupon it is moved to a further extended position for eventual horizontal lateral transfer to the sewing head assembly.

Looking now at FIGS. 5, 5*a*, and 5*b*, there will be explained the supporting apparatus for the pincer assemblies 104,106, the impaling tongue 108, and the inverter or folder blades 110,112. A lever support brace 114 is mounted to the rear of front wall 103 of carriage 102 adjacent an opening 116 therein through which the clamp assemblies 104,106, the impaling tongue 108, and the inverting blades extend. Lever support brace 114 is generally vertically oriented and parallel to the side edge of said opening 116 and extends rearwardly from the rear surface of plate 102. A lever support member 118 is secured to the rear edge of lever support brace 114 and includes upper and lower transverse openings therethrough which receive upper and lower pincer shafts 120,122. Upper pincer lever 124 and lower pincer lever 126 are secured in non-rotatable relation to pincer shafts 120,122 respectively. A double acting hydraulic cylinder 128 extends between the free ends of levers 124,126 for the activation thereof. When the double acting cylinder 128 is activated to extend the piston thereof, the free end of levers 124 and 126 spread causing a counterclockwise rotation of pincer shaft 120 and a clockwise rotation of pincer shaft 122 for reasons to be hereinafter described.

As best shown again in FIGS. 5 and 5*a*, a pincer cylinder mounting bracket 130 is secured in non-rotatable relation to pincer shaft 120 on the opposite side of lever support 118 through a transverse opening 132 therein. The pincer cylinder mounting bracket 130 includes a longitudinal passageway 134 through which a pincer slide 136 extends. One gripping jaw 138 is secured to the front end of bracket 130 and includes an opening 140 therein through which the pincer slide 136 reciprocates. A second jaw 142 is secured to the front or forward end of pincer slide 136. A double acting hydraulic cylinder 144 is secured to the rear end of bracket 130 with the piston 146 thereof in operative engagement with the rear end of pincer slide 136.

Thus, in operation, as lever 124 and pincer shaft 120 are rotated in counterclockwise fashion by the extension of hydraulic cylinder 128, the pincer cylinder mounting bracket 130 is also caused to rotate with the result that the jaws 138,142 are moved downwardly into engagement with the upper ply of the waistband fabric. Responsive to a prescribed program to be hereinafter described, the double acting cylinder 144 is then activated to retract the piston 146 thereof and thus pincer slide 136, causing the forwardmost jaw 142 to be retracted into pincing or gripping engagement with the rear jaw 138.

Although not easily seen in FIG. 5 (but visible in FIGS. 3 and 4), there is a second pincer cylinder mounting bracket 131 identical in construction but mounted in upside down relation to bracket 130 on pincer shaft 122. While the first bracket 130 is pivoting downward into engagement with the upper ply of the fabric of the waistband, the lower pincer cylinder mounting bracket 131 is being caused to simultaneously rotate upwardly responsive to the clockwise rotation of pincer shaft 122 into engagement with the lower ply of the fabric of the waistband. Hydraulic cylinder 145 acts simultaneously with hydraulic cylinder 144 to cause the jaws of the lower pincer assembly to grip simultaneously with the jaws of the upper pincer assembly. Upper and lower pincer cylinder mounting brackets 130,131 are then pivoted in the opposite direction to spread the fabric plies.

A folder housing 150 is secured to the side of lever support 118 adjacent to and extending slightly into the opening 116 in front plate 102 between the upper pincer assembly 130 and the lower pincer assembly 131. Housing 150 supports the impaling tongue 108 and the folder blades 110 and 112 for reciprocal movement between bearing plates 113. Impaling tongue 108 is attached to the piston 152 of a double acting hydraulic cylinder 154 which is, in turn suspended from a movable support bracket 190. Folder blades 110,112 are supported between bearing members 113 within housing 150 (see FIG. 5*b*). Another double acting hydraulic cylinder 156, suitably mounted in carriage 102, engages projections 110*a*,112*a* extending from the sides of upper and lower folder blades 110,112 through slots in the side wall of housing 150 to activate the folder blades in reciprocal fashion as the impaling tongue retracts (see FIG. 5*b*).

Support bracket 190 is slidably mounted on a pair of spaced rails 192 which extend between the front and rear walls of carriage 102. The cylinder portion of a second or auxiliary hydraulic cylinder 194 is secured to the rear wall of carriage 102 while the free end of the piston 195 is attached to a front wall or abutment 196 on bracket 190. So arranged the first hydraulic cylinder 154 operates the tongue 108 between its normal waistband receiving position and its retracted position, and the second hydraulic cylinder 194, when activated, moves the tongue out to its extended position by moving the bracket 190, first cylinder 154, and the tongue 108 together as a unit.

Figure 8D:
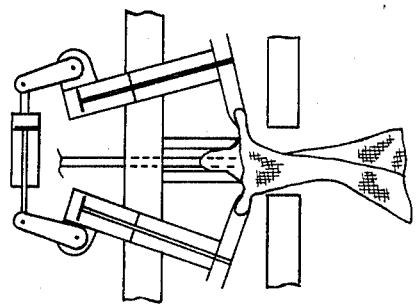
Figure 8C:
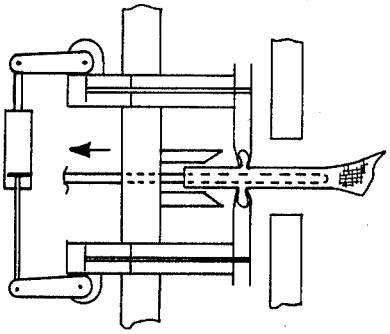
Figure 8B:
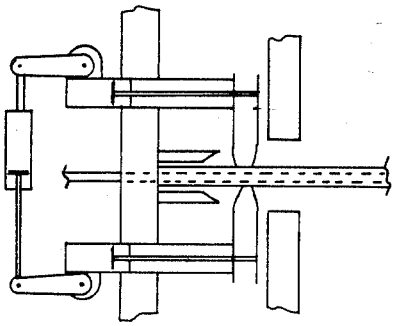
Figure 8A:
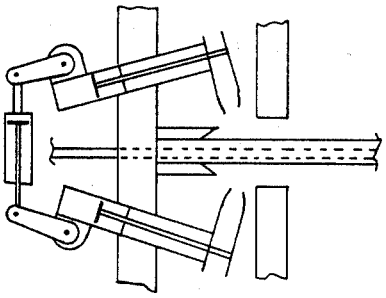

In the initial waistband receiving position shown in FIG. 3, the impaling tongue 108 is projected into a first receiving position for receiving and supporting a waistband free terminal end portion and a portion of the waistband of the garment thereon. At this time, the folder or inverter blades 110,112 are retracted, and the pincer assemblies 104,106 are open and separated (FIG. 8*a*). Subsequently, hydraulic cylinder 128 is activated to bring the pincer assemblies 104,106 together, whereupon hydraulic cylinders 144,145 are activated to cause the pincing jaws 138,142 of pincer assemblies 104,106 to begin to grip the fabric as illustrated in FIGS. 8*b* and 8*c*. Once the fabric of the upper and lower waistband plies is gripped, cylinder 128 is reversed to cause the pincer assemblies 104,106 to rotate in a direction away from each other pulling the fabric plies apart. At the same time, or slightly before the fabric plies are pulled apart, hydraulic cylinder 154 is then retracted to begin to withdraw the impaling tongue 108 while cylinder 156 is activated to begin to extend the upper and lower folding blades 110,112 (see FIGS. 8*d* and 8*e*). After the inverting operation, blades 110,112 are retracted. As the tongue 108 begins to return to its receiving position the flattening operation which will be described hereinafter occurs. Following the flattening operation, the pincer jaws 138,142 are released. After the ensuing sewing operation, the carriage 100 is returned to its receiving position ready to receive another waistband or the opposite side of the first waistband. It should be noticed here that the apparatus must be sequenced twice to complete both terminal free end portions of the waistband of a single garment.

(b) Waistband End Flattening Mechanism

Turning now to FIGS. 3 and 4, there is best illustrated the waistband end flattener mechanism 160 which in general includes a pair of vertically oriented opposed presser feet 161,163 which are moved back and forth between a retracted position (FIG. 3) and a flattening position (FIG. 4) responsive to the movement of a double acting pneumatic cylinder 166 through an inner-connecting linkage 168. Linkage 168 is pivotally supported between a pair of side walls 170,172 by a plurality of support pins 173,174, and 175.

In describing the linkage, attention is first directed to the forward end of the piston 167 of the pneumatic cylinder 166. A thrust block 176 is attached to the forward end of piston 167 and is inserted between upper thrust links 178 and lower thrust links 180, it being understood that pin 175 extends through the lower ends of upper thrust links 178, the upper ends of thrust links 180 and a forward extension 177 of thrust block 176, as well as into bearing relationship with side walls 170,172. The upper ends of thrust links 178 and the lower ends of thrust links 180 are then pivotally attached to a vertically extending upper connector block 182 and lower connector block 184 by means of pivot pins 181. A plurality of horizontally extending links 186*a*–186*d* mounted on pivot pins 173 pivotally connect the upper end of vertical connecting block 182 with the upper end of the upper presser foot 161 as illustrated in FIGS. 3 and 4. Similarly, the lower horizontal linkage 188, which is mounted on pivot pin 174 connects the lower end of connecting block 184 with the lower end of the lower presser foot 163. All of the links 186*a*–186*d* and 188*a*–188*d* are pivotally connected to the connector blocks 182,184 and presser feet 161,163.

So arranged then, when the piston 167 of pneumatic cylinder 166 is retracted, the thrust links 178,180 are withdrawn to the position illustrated in FIG. 3. In this position, the upper horizontal link-ages 186*a*–186*d* are inclined downwardly from front to rear and the lower horizontal linkages 188*a*–188*d* are inclined upwardly from front to rear. Because of the pivot pins 173,174 maintaining the center point of links 186,188 in the same position, this then results in a separation of the presser feet 161,163.

When the piston 167 of the pneumatic cylinder 166 is then moved forwardly as illustrated in FIG. 4, thrust linkages 178,180 are caused to assume a more vertical position, with the result that the connector block 182 is thrust upwardly and connector block 184 is thrust downwardly. The resulting pivotal movement about pins 173,174 then cause the presser feet 161,163 to come together with the fabric therebetween resulting in the flattening operation.

(c) Mechanism For Transporting Waistband End Portion To Sewing Head

Once the folding and flattening operation has been completed as hereinabove described, it is necessary to transfer the waistband end portion to the sewing head assembly 200. For this purpose, the impaling tongue 108 is reinserted into the waistband by clyinder 154 and extended by hydraulic cylinder 194 to a forwardmost or extended position in which the finished edge of the waistband portion is approximately aligned with the sewing position, however, slightly forwardly offset therefrom for reasons to be described hereinafter. The next step is to transfer the carriage 102 laterally to deliver the waistband portion into the sewing head assembly area (FIG. 2).

For this purpose, and as hereinabove described, the carriage 102 is mounted on a pair of rails 16 extending between corresponding horizontal members of the machine framework 12. Looking now at FIG. 10, carriage 102 includes a plurality of bearing members 54,56 which slidably mount carriage 102 on rails 16. A depending abutment 58 extends downwardly from the bottom wall of the carrier adjacent the sewing head assembly. A double acting hydraulic cylinder 59 is suitably mounted to the apparatus framework 12 and includes a piston 60 which engages and is secured to the previously mentioned abutment 58. Upon activation at the completion of the inverting and flattening operation, piston 60 is extended which causes the carrier to move toward the left in FIG. 10 until abutment 58 engages a microswitch 62, which causes the traversing operation to cease. At this point, the waistband portion of the garment carried on impaling tongue 108 is in the general area of the sewing head assembly 200 in position to be received thereby for the sewing operation.

(d) Mechanism for Gripping and Positioning Waistband End At Sewing Head

At the station (FIGS. 6 and 7) in which the sewing operation is to be carried out, there is provided a garment securing means in the form of a lower cloth plate 202, a lower stripper plate 204, an upper stripper plate 206, and a spring plate 208 which tends to maintain the upper stripper plate 206 biased toward the lower stripper plate 204. The finished edge of the waistband end portion is initially received at the sewing head assembly between the upper stripper plate 206 and the lower cloth plate 202 with the finished edge positioned slightly forwardly from the lower stripper plate 202. At this moment, the impaling tongue 108 extends between the upper stripper plate 206 and lower stripper plate 204 inside the waistband. Eventually the tongue 108 will be retracted rearwardly to such an extent that the carriage 50 is free to return to its normal home position.

As the finished edge and terminal end portion of the waistband is received between upper stripper plate 206 and lower cloth plate 202, a portion of the waistband further removed from the finished edge is received by a gripping mechanism 210. It is this gripping mechanism 210 which provides the positive gripping and movement of the finished edge into proper alignment with the needle of the sewing head 200 which is one of the important aspects of the present invention.

The gripper assembly 210 is mounted to a mounting plate 214 suitably secured to a convenient portion of the machine framework 12 in close proximity to the garment securing means 202,204,206,208. A downwardly depending plate 212 is secured to one edge of mounting plate 214. Mounting plate 214 includes a finger 216 which is spaced from the edge thereof and the surface of upstanding plate 212 forming a notch for receiving and guiding the movement of a lever arm 218. Lever arm 218, in turn, is pivotally attached to the lower portion of upstanding plate 212 by a pivot pin 220. A spring 212A is mounted on the face of plate 212 in the path of lever arm 218 to delay the movement of the lever arm as will be hereinafter described. A rearwardly extending support arm 222 is secured at one end to the upper end of lever arm 218 and extends toward the sewing head assembly and terminates in an upper gripper jaw which is an integral part of the arm 222 and extends at approximately a right angle thereto. A lower gripper jaw 226 which includes a pair of inclined upper surfaces is pivotally attached at its apex to the upper jaw 224 by means of a mounting brackets 228.

The upper surface 227 of lower gripper jaw 226 inclines upwardly from the free end thereof to a point approximately midway along the lower gripper jaw 226, then tapers downwardly to the rear end thereof. A double acting pneumatic cylinder 229 is secured at the lower end thereof to upstanding support plate 212 and includes a piston 230, the free end of which is pivotally attached to the rear end of lower gripping jaw 226. So arranged, as the piston 230 of the pneumatic cylinder 229 is retracted, the forward end of jaw 226 is lifted upwardly into engagement with the upper gripping jaw 224, firmly holding the waistband portion therebetween.

It should be here noted that the upstanding lever arm 218 is tilted or angled slightly forwardly in the normal position illustrated in FIG. 6. As a result, as the piston 230 of pneumatic cylinder 229 continues to be retracted after gripping has occurred, the lever 218 is caused to pivot in a counterclockwise direction (FIG. 6), which results in a slight inward or rearward movement of the finished edge of the waistband end portion toward the lower stripper block 204. It should be noted here that spring 212A delays the movement of lever arm 218 and ensures that jaw 226 will be fully closed before lever arm 218 moves inwardly or rearwardly (FIG. 7). The aforesaid inward movement causes the finished edge to be positively moved into engagement with the lower stripper block 204 which serves also as a stop means for positively positioning the finished edge in proper arrangement with the needle of sewing head 200 (FIG. 7).

Therefore, cylinder 229 serves a double purpose, i.e. first in causing the lower gripper jaw 226 to move into gripping relationship with the upper gripper jaw 224 and secondly in causing the lever 218 to swing in a counterclockwise direction after gripping has occurred to positively position the finished edge of the waistband end portion. Once the positioning operation has occurred, and prior to the time sewing commences, the impaling tongue 108 is retracted, the waistband stripped therefrom, and the carriage 50 removed to its home position. The sewing operation is then carried out, preferably by moving the sewing head across the waistband end portion as it is held in place according to well known techniques, and the complete operation is finished.

(e) Electro-Mechanical Control System

In order to sequentially activate the valves of the hydraulic and pneumatic cylinders in accordance with the prescribed program, there is provided a hydraulically operated, cam actuated switching system as best illustrated in FIG. 9. While the timing control of the waistband end finishing apparatus could be operated by a computer, microprosessor, or other conventional timing apparatus, in the preferred embodiment a programmer cylinder 300, operated responsive to the increase in exhaust oil from the various hydraulic cylinders associated with the inverter head assembly 100, is utilized in conjunction with a rotatable cam shaft 320 and a bank of micro-switches 340 (also referred to hereinafter as "cam switches").

A front and rear bank of micro-switches 342,344 are mounted in angularly disposed relation to each other from a support rack (not shown) which in turn is carried by a pair of spaced support walls 302. The cam shaft 320 is also supported by the walls 302 and carries a plurality of cams 322 and 324 in such a manner that as the cam shaft rotates, cams 322 engage operators of micro-switches 342 and cams 324 engage the operators of micro-switches 344. Cam shaft 320 further carries a cam shaft drive sprocket 326 which is engaged and caused to rotate by an endless chain 328.

The piston 304 of programmer cylinder 300 includes an actuating arm 306 secured to the free end thereof which is attached to a lug 308 on the rear flight of endless chain 328. A pair of guide sprockets 330,332 along with cam drive sprocket 326 support and carry chain 328 in a reciprocating path. As each hydraulic cylinder is activated, as herein described, the exhaust oil is delivered to the programmer cylinder 300 through line 310. Thus as each of the operating hydraulic cylinders is activated, the amount of oil beneath the piston 304 of the programmer increases causing the piston to rise. As the piston 304 rises to different positions chain 328 also rises vertically rotating drive sprocket 326 in a counterclockwise direction (FIG. 9).

The movement of drive sprocket 326 causes a corresponding movement of cam shaft 320. As a result each time oil is delivered to cylinder 300, another one of cams 322,324 is caused to move into operative engagement with the contact of one of the micro-switches 342,344. The closing of each of cam operated micro-switches 342,344 electronically triggers or activates the next sequence of events as described more fully hereinbelow.

(f) Electrical and Hydraulic Operation

Referring now to FIGS. 11–13 the electrical, hydraulic, and pneumatic operation of the device will be discussed. First, with respect to FIG. 11, when the main switch is turned on, the twelve-volt transformer and 110-volt transformer are both energized. As the operator depresses the START button (reference lines 11, 12) current is provided to turn on the sewing machine motor, the pump motor, the sewing machine light, as well as energizing the coil of reset relay CR-2 which, when energized, returns all cam switches and components of the apparatus to their "home" position including the valve control programmer (FIG. 9). The coil of control relay CR-1 is also energized which deactivates all of the cam switches and locks the valve control programmer in its home position as long as control relay CR-1 is energized. Depression of the START switch also activates the foot up switch to energize valve coil 1 of valve V9 (hereinafter written valve "V9-1") which ensures that the sewing machine instrumentalities are in the up position, as well as to energize valve V10-1 (coil 1 of valve V10) which ensures that the garment clamp 224,226 is open.

At this time the hydraulic pump should be running, the sewing machine motor should be running, the traverse, tongue, folders, grip, pincers, support rod, tongue extension, flattener, and pince release valve should all be in the "home" position.

The CYCLE switch is then closed or depressed. The normally opened contact on reference line 53 is opened and current through wire 38 to the oil dump valve V14 is interrupted. This will de-energize valves V13, V14, and control relay CR-1. Normally closed contacts 1 and 2 of control relay CR-1 will close and energize wire 11 leading to the cam switches of the programmer assembly. Also the normally open contact on reference line 17 is closed and wire number 46 is energized through contact 6 and 7 of control relay CR-3. Wire 17 is energized through foot switch contacts, wires 57 and 58 are then energized, the sewing machine clamp valve V9-1 is in the up position and the garment clamp valve V10-1 is in the open position. Finally, the pincer valve V1-2 is closed which begins the cycle process.

Closing of the pincer valve V1-2 will activate hydraulic cylinder 128 to cause the pivotal movement of pincers 104,106 as described hereinabove until they engage the upper and lower plies of fabric mounted on impaling tongue 108 (FIGS. 3 and 4). As the oil is displaced in the pincer cylinder 128, enough oil is displaced to the program cylinder to begin activation thereof. Since the program cylinder has no oil pressure in the top portion, the piston rod is allowed to move upwardly, while the oil dump valve will allow the oil in the top of the cylinder to return to the holding tank. The program cam switches control the cyclic operation from this point on. The first rotating cam 322 or 324 will close cam switch CS-2 (reference line 20) energizing the closure of gripper close valve V2-2, which activates hydraulic cylinders 144,145 to close the pincers 138,142 of pincer assemblies 104,106. This again displaces more oil in the program cylinder, causing the program cam to rotate further closing cam switch CS-3. The closure of cam switch CS-3 energizes the tongue retraction valve V3-2. In the next step cam switch CS-4 is activated which closes and energizes pincer open valve V1-1 to separate the plies of fabric (FIG. 8*d*).

It should be noted here that the program cylinder 300 is driven by the displacement of oil, therefore every time a cam actuates a switch, the switch should activate a valve, the valve should activate a cylinder, which should displace more oil to further drive the program cylinder, and thus the cycle continues. It is only felt necessary to continue to successive steps in the operation, without repeating the manner in which the program advances through the cycle.

In the next step the cam switch CS-5 is closed to energize the folders out valve V4-2 to commence the inverting operation. Cam switch CS-6 is then closed to release slightly the pince open valve V8-2. Actuation of cam switch CS-7 closes and energizes the tongue displacement valve V4-1 in the opposite direction to retract the folders. Subsequently, actuation of cam switch CS-8 energizes the valve V3-1 controlling the tongue cylinder to return the tongue 108 to the normal receiving position. As the tongue is moving out, cam switch CS-29 is activated to close and energize pneumatic valve V15 to operate the flatteners through air cylinder 166.

Cam switch CS-9 then operates to activate valve V2-1 to open the gripper jaws and activates valve V8-1 to return the pincer assemblies 104,106 to their normal position. The actuation of cam switch CS-10 then activates the tongue extension valve V5-2 to cause the impaling tongue 108 to be moved to its outermost position, whereupon switch CS-11 is closed to activate cylinder 59 through valve V7-2 to cause traversing of the carriage 102 to its position adjacent the sewing machine. As the carriage 102 reaches its limit, it engages limit switch LS-12 which causes a retraction of the impaling tongue and impaling tongue extension cylinders. Actuation of cam switch CS-13 activates valve V9-2 to urge the presser foot downwardly, as well as to activate closure of the garment clamp jaws through valve V10-2. Successive actuation of cam switches CS-15 and CS-16 then cause the garment support to move the waistband into the sewing position (thru valve V6-2) and sewing operation to ensue (thru valve V11).

Upon completion of the sewing operation, the actuation of cam switch CS-19 causes valve V7-1 to be activated returning the carriage 102 to its normal position. Actuation of valve V6-1 releases the garment clamp jaws. As carriage 102 reaches its normal position, the engagement of limit switch LS-22 energizes valves V13, V14 and control relay CR-1 to return the programmer to its home position, dump the oil into the holding tank, open contacts 1 and 2 on reference line 17, and deactivate all of the cam switches, whereupon the apparatus is ready for the next cycle.

(g) Sequential Operation

The sequence of operation through a single cycle from the home position may best be explained by reference to the schematic illustration shown in FIGS. 8A–8H and to FIGS. 6 and 7. A waistband with its free terminal end portion and a depending garment is placed on the impaling tongue member 108 with the end of the waistband or garment abutting against the stop block 102A of the carriage 102. The operator then actuates the "CYCLE" switch thereby activating hydraulic cylinder 128 to move the pincers 104,106 together. At the appropriate time, cylinders 144 and 145 are activated to squeeze the jaws 138,142 of each pincer together to releasably clamp or grip a portion of the waistband fabric in the jaws on opposite fabric sides. The impaling tongue member 108 is then partially withdrawn from its receiving position by means of the activation of cylinder 194 while cylinder 128 will be activated in the opposite direction to pivot the jaws of pincer assemblies 104,106 away from each other as the impaling tongue 108 is completely retracted as shown in FIG. 8D.

Figure 8H:
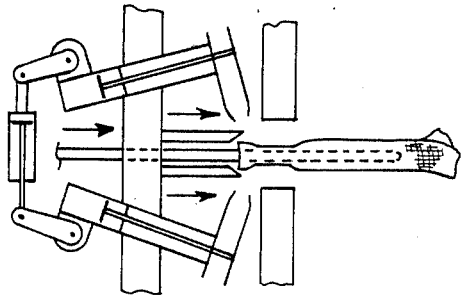
Figure 8G:
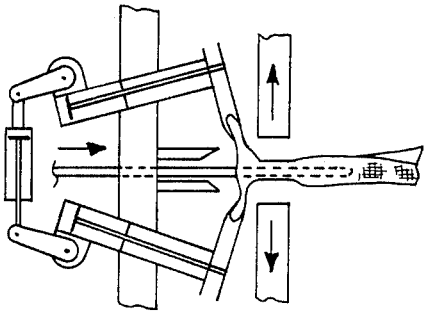
Figure 8F:
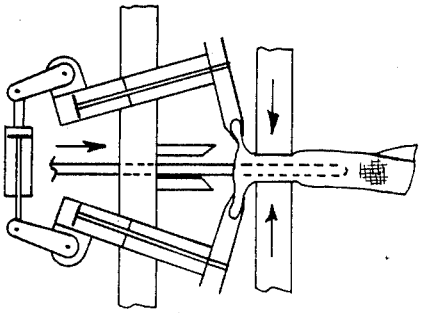
Figure 8E:
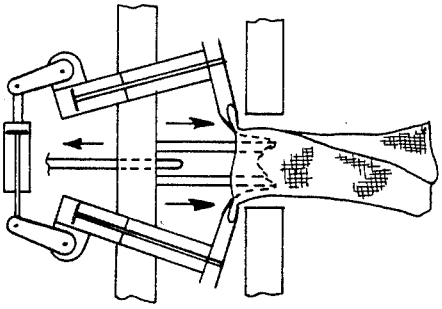

At the same time the cylinder 156 is activated to move the upper and lower folding blades 110,112 outwardly (FIGS. 8D and 8E). The inverter blades engage the spread fabric and invert the free terminal end portion into the waistband as shown in FIGS. 9E and 9F. After the waistband has been inverted the fluid to cylinder 156 is reversed and the inverting blades 110,112 are withdrawn. Once the blades 110,112 are withdrawn and as the impaling tongue 108 is returned, cylinder 166 is activated to bring the pressing jaws 162,164 together. No damage is caused to the impaling tongue because in reference to FIG. 3, there are slight offsets at the free ends of presser feet 161,163 to accommodate the thickness of the tongue, as it is the fabric adjacent the corner of the finished edge that is desired to be flattened, and not the fabric entirely across the finished edge. Therefore, the presser feet can be pressed together with the fabric therebetween without damaging the impaling tongue 108. Upon completion of the flattening operation, the presser feet 161,163 are returned to their normal or "home" position, the pincer members 104,106 are released and returned to their "home" position, and the impaling tongue 108 is inserted between the plies of the waistband with the finished edge ready for transporting to the sewing station for the seaming operation (FIGS. 3, 8G and 8H).

As has been stated hereinabove, the waistband finishing operation is conducted in substantially the same horizontal plate as the seaming operation, and therefore it is only necessary to transfer the waistband portion laterally to the sewing head assembly. The first step in this operation is an extension of the impaling tongue 108 by cylinder 194, so that the finished edge of the waistband is extended forwardly beyond the inverting and flattening apparatus and substantially in alignment with the needle of the sewing head assembly, although at this time, the finished edge is even slightly forwardly of strict alignment with the needle for reasons to be hereinafter described.

Cylinder 59 is then activated to move carriage 102 laterally to a position in which the waistband portion is received between the jaws 224,226 of the gripping apparatus 210 and between the upper stripper plate 206 and lower stripper plate 202. At this point in time, the finished edge of the waistband portion is spaced slightly forwardly of the lower stripper plate or stop block 204. During the foregoing operation, the exposed portion of the impaling tongue 108 has slid between the upper stripper plate 206 and the lower stripper plate 204. For this purpose the end of the upper stripper plate facing the inverting and flattening apparatus is curved slightly upwardly to guide the the side edge of impaling tongue 108 therebetween.

Cylinder 229 is then activated to retract the piston 230 thereof causing the lower jaw 26 to pivot upwardly into gripping engagement with the upper jaw 224 with the waistband portion therebetween. Continued retraction of piston 230 then causes the lever 218 to pivot in a counterclockwise direction and urge the finished edge of the waistband portion against the lower stripper plate 204. During completion of this shifting movement, cylinders 154 and 194 are activated to retract impaling tongue 108, whereupon the carriage cylinder 59 is reactivated to retract carriage 50 to its home position.

The finished edge of the waistband portion, at this time, is ready for the seaming operation, which is carried out according to conventional methods. Upon completion of the seaming operation, the piston 230 of cylinder 229 is again extended to retract the garment and release jaws 224,226. This completes a cycle, and the equipment is now reset ready to repeat the above-described operation.

Although a preferred embodiment of the invention has been described in detail hereinabove, it is apparent that various changes and modifications might be made without departing from the scope of the invention which is set forth in the accompanying claims.

What is claimed is:

1. An improved automatically and sequentially operated apparatus for inverting a tubular portion of a garment waistband having fabric plies opposite each other with an open terminal free end portion and for stitching the plies of the open inverted free end together, said apparatus comprising:

(a) an inverting head assembly including a waistband impaling tongue means for supporting said waistband and said waistband open terminal end portion thereon, said inverting head assembly further comprising:

(i) automatically actuated means for initially releasably clamping and spreading the fabric plies of the waistband in spaced relation to the open terminal free end portion thereof;

(ii) automatically actuated means for thereafter inverting the open terminal free end portion of the waistband into the spread waistband thereby forming an inturned edge having a thickness of four plies and making a selected bulky area adjacent the juncture of the lower edge of the waistband adjacent said inturned edge;

(iii) automatically actuated flattening means for thereafter pressing said selected bulky area of the end portion of the waistband to reduce the thickness thereof in preparation for the ensuing stitching operation;

(b) a sewing head assembly comprising sewing instrumentalities positioned in transversely spaced relation to said inverting head assembly;

(c) said sewing head assembly and said inverting head assembly being so arranged with respect to each other that said waistband end portion is inverted and sewn while being maintained in substantially the same horizontal plane;

(d) shifting means for moving said inverting head assembly toward said sewing head assembly while maintaining said waistband end portion in said horizontal plane;

(e) gripping means associated with said sewing head assembly and in the path of movement of said inverter head assembly for receiving and gripping said waistband portion, said gripping means further including shifting means for positively moving the inturned edge of said waistband portion into proper alignment with said sewing head assembly for stitching the open free ends together.

2. The apparatus according to claim 1 wherein said flattening means includes a pair of opposed presser feet movable between a first open or retracted position and a second flattening position in which said pair of opposed feet are brought together, a pneumatic cylinder selectively operable responsive to a prescribed program for moving said pair of opposed feet between said first and second positions.

3. The apparatus according to claim 2 and further including a linkage means between the piston or said pneumatic cylinder and each of said pair of opposed feet, said linkage means being operable to move said opposed feet between said first and second positions responsive to movement of the piston of said pneumatic cylinder.

4. The apparatus according to claim 1 wherein said inverting head assembly includes an impaling tongue activating means for moving said impaling tongue between a normal receiving position, a second retracted position, and a third extended position, said sewing head including instrumentalities fixed in a sewing position, said extended position of said impaling tongue causing said inturned edge of said waistband portion to be positioned slightly forwardly of said sewing position, said gripping means including a receiving position aligned with the extended position of said impaling tongue, and shifting means for moving said gripping means rearwardly into said proper position for stitching.

5. The apparatus according to claim 4 wherein said gripper means includes a pair of opposed jaws, said jaws mounted on a lever which in turn is pivotally mounted to the machine framework, and a pneumatic cylinder in operative engagement with at least one of said opposed jaw members, activation of said pneumatic cylinder causing said jaws first to close and then said lever to pivotally move, which in turn effects said shifting movement of said finished edge into the sewing position.

6. An improved automatically and sequentially operated apparatus for inverting a tubular portion of a garment waistband having fabric plies opposite each other with an open terminal face end portion comprising an inverting head assembly including a waistband impaling tongue means for supporting said waistband and said waistband open terminal end portion thereon, said inverting head assembly further comprising:

(a) automatically actuated means for initially releasably clamping and spreading the fabric plies of the waistband in spaced relation to the open terminal free end portion thereof;

(b) automatically actuated means for thereafter inverting the open terminal free end portion of the waistband into the spread waistband thereby forming an inturned edge of a thickness of at least four plies, and making a selected bulky area adjacent the juncture of the lower edge of the waistband adjacent said inturned edge;

(c) automatically actuated flattening means for thereafter pressing a selected area of the enthickened end portion of the waistband to reduce the thickness thereof in preparation for the ensuing stitching operation.

7. The apparatus according to claim 8 wherein said flattening means includes a pair of opposed feet movable between a first open or retracted position and a second flattening position in which said pair of opposed feet are brought together, and a pneumatic cylinder connected to said pair of opposed feet and selectively operable responsive to a prescribed program for moving said pair of opposed feet between said first and second positions.

8. The apparatus according to claim 6 and further including a linkage means between the piston of said pneumatic cylinder and each of said pair of opposed feet, said linkage means being operable to move said opposed feet between said first and second positions responsive to movement of the piston of said pneumatic cylinder.

9. An automatically and sequentially operated apparatus for stitching the open inverted free end of a tubular portion of a garment waistband having fabric plies opposite each other with an open terminal free portion thereof which has been previously inverted, said apparatus comprising a sewing head assembly and a gripping means associated with said sewing head assembly for receiving and gripping said waistband portion, said gripping means further including transferring means for positively moving the inturned finished edge of said waistband portion into proper position for stitching the open inverted free ends together.

10. The apparatus according to claim 9 wherein said gripper means includes a pair of opposed jaws, said jaws mounted on a lever which in turn is pivotally mounted to the machine framework, and a pneumatic cylinder in operative engagement with at least one of said opposed jaw members, activation of said pneumatic cylinder causing said jaws first to close, and then said lever to pivotally move, which in turn effects said shifting movement of said finished edge into the sewing position.

* * * * *